United States Patent [19]

Kume et al.

[11] 4,026,100

[45] May 31, 1977

[54] TIMEPIECE WITH CALENDAR MECHANISM

[75] Inventors: Kazunari Kume; Minoru Watanabe, both of Tokorozawa; Hideshi Oono, Sayama; Munetaka Tamaru, Tokyo, all of Japan

[73] Assignee: Citizen Watch Co., Ltd., Tokyo, Japan

[22] Filed: Sept. 23, 1975

[21] Appl. No.: 616,042

[30] Foreign Application Priority Data

Sept. 25, 1974 Japan ..... 49-110203

[52] U.S. Cl. ..... 58/4 R; 40/113

[51] Int. Cl.[2] ..... G09D 3/08; G04B 19/24

[58] Field of Search ..... 40/107, 113; 58/4 R, 58/4 A, 58, 85.5

[56] References Cited

UNITED STATES PATENTS

| | | | |
|---|---|---|---|
| 3,400,510 | 9/1968 | Schwarzer et al. | 58/4 R |
| 3,695,029 | 10/1972 | Tripet | 58/58 |
| 3,909,966 | 10/1975 | Sato | 58/4 R |

*Primary Examiner*—E. S. Jackmon

*Attorney, Agent, or Firm*—Sherman & Shalloway

[57] ABSTRACT

A timepiece with a calendar mechanism for automatically correcting the date-indication at each end of the months with thirty days or less, which comprises first driving means for feeding a date dial, second driving means for selectively driving the date dial and means for controlling the second driving means to energized it at the end of the month with thirty days or less. The second driving means is supplied with a power blanched from the power transmitting route for the first driving means thereby resulting in the simplification in its construction.

6 Claims, 5 Drawing Figures

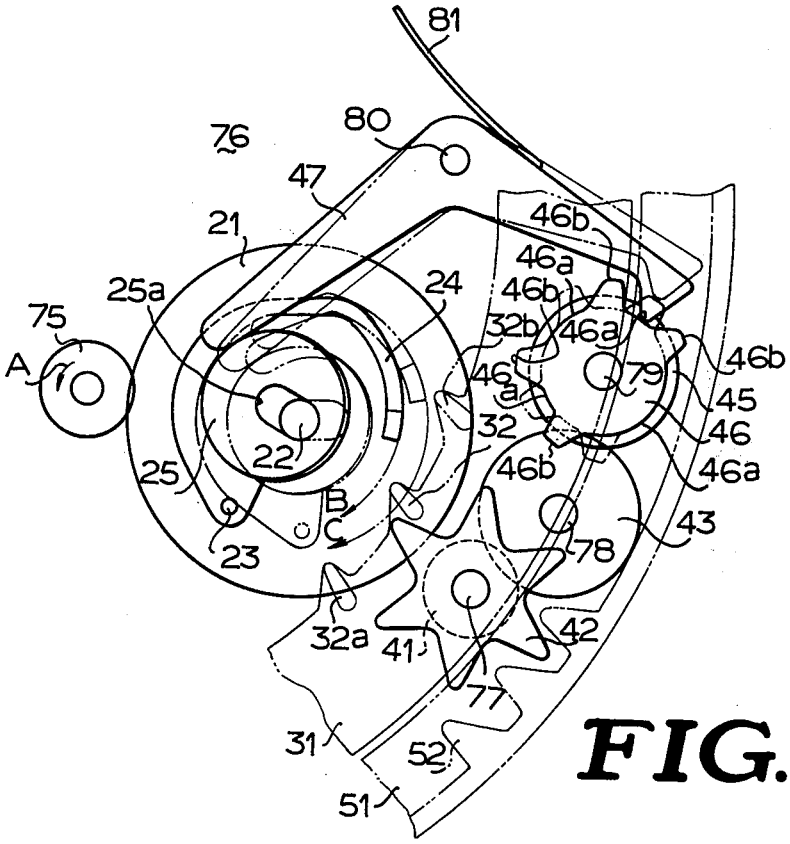
FIG. 3
FIG. 4
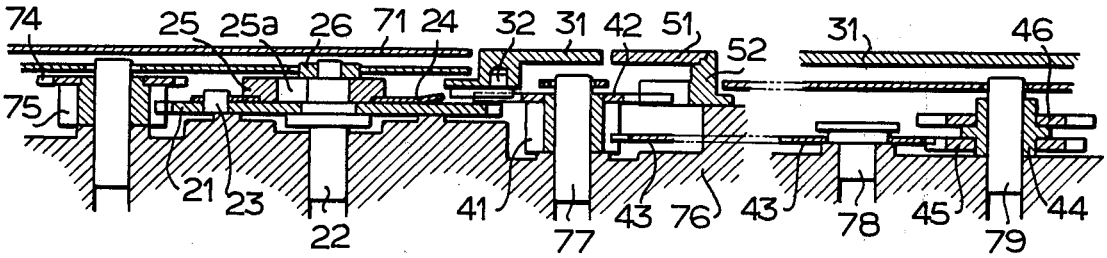
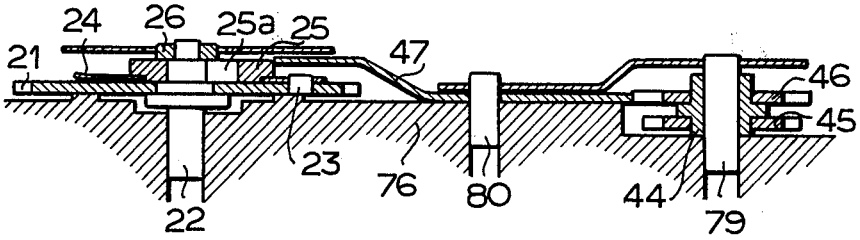
FIG. 5

TIMEPIECE WITH CALENDAR MECHANISM

BACKGROUND OF THE INVENTION

This invention relates to a timepiece with a calendar mechanism wherein the indication of the date is automatically corrected at each end of the months with thirty days or less days.

In order to eliminate the manual operation for correcting the indication of the date, there have been proposed several types of automatic date-correcting mechanisms. The already proposed mechanisms, however, will necessarily become larger in size in order to maintain accurate operation consequentially these mechanisms can not be used with to wrist watches.

SUMMARY OF THE INVENTION

It is an object of this invention to provide a timepiece with a calendar mechanism which is capable of automatically correcting the indication of date the wherein the mechanism is relatively small in size without sacrificing reliability.

The automatic date-correcting mechanism of this invention basically includes a display means the date; first driving means for energizing the display means once a day to correct the date indication in accordance with a time keeping device second driving means for energizing the display means at the each of each month with thirty days or less by means of power delivered from the transmission route branched from the first driving means and a controlling means for the second driving means.

Other features and advantages of this invention will be clearly understood from the following description with reference to the accompanying drawings, in which:

BRIEF DESCRIPTION OF THE DRAWINGS

FIG. 3 is a plan view of the mechanism of the timepiece shown in FIG. 2; and

FIGS. 4 and 5 are longitudinal sections of the mechanism shown in FIG. 3.

DESCRIPTION OF THE PREFERRED EMBODIMENTS

Figure 1:
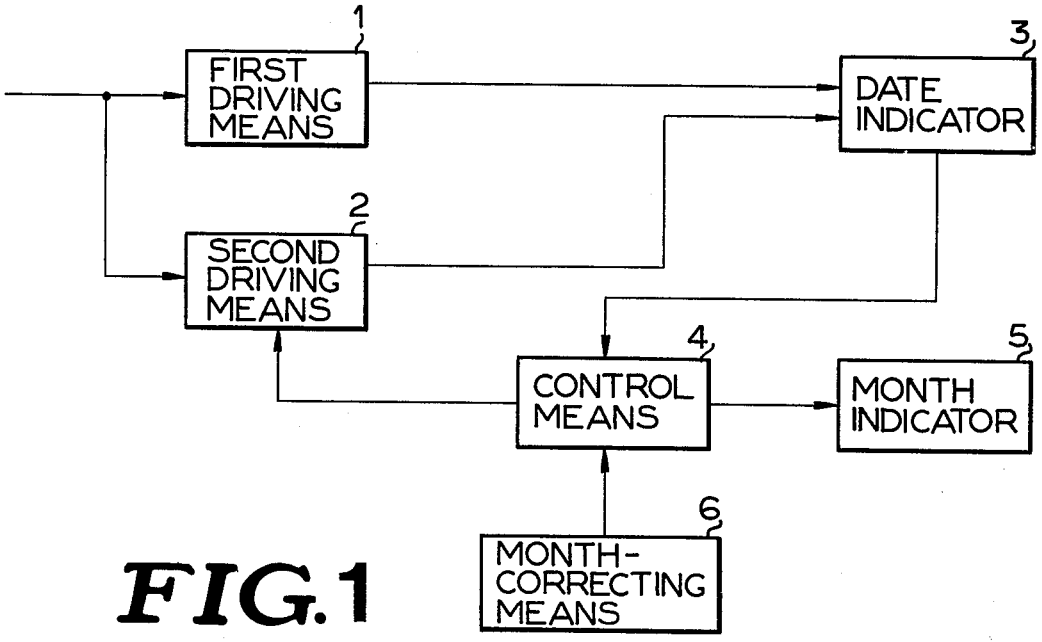
FIG. 1 is a block diagram showing the construction of the date-correcting mechanism embodying this invention.

Referring now to the drawings, more particularly to FIG. 1, the driving power delivered from a time keeping device (not shown) is branched and transmitted to first and second driving means 1 and 2, each of which has pawls for driving date-indicating means 3 and rotates one full rotation each day. The date-indicating means 3 possesses a date-indicating member and a pin planted on the member to detect one full rotation of the member, i.e., the completion of the daily indication for a month. The driving power of the member is transmitted through the pin to control means 4 which has a month-discriminating mechanism producing a signal for controlling the second driving means 2. Furthermore, the control means 4 drives month-indicating means 5 to indicate the month. A month-correcting means 6 can correct the state of the control means 4 and month-indicating means 5.

In operation, the ordinary date-correcting operation is performed by feeding the date-indicating member of the date-indicating means 3 by the driving pawl of the first means 1 around 12 o'clock midnight each day.

On the other hand, the driving pawl of the second driving means 2 rotates with the phase difference from the driving pawl of the first driving means 1 for about three hours, but does not feed the date-indicating member, because the pawl of the second means 2 is so constructed as not to engage with the monthly pin. The monthly pin is so arranged as to engage with the control means 4 only when the displayed date by the date-indicating member changes from "31st" day to "1st" day, and to engage with the pawl of the second driving means 2 when the pawl moves in accordance with the instructions from the control means 4, so that the timepiece operate as follows.

At each end of the 31-day months, the date-indicating member is fed by the pawl of the first driving means 1 to change the indicated 31st day to the 1st day. At this time the monthly pin energizes the control means 4 by which the month-discriminating mechanism and month-indicating member are energized to turn the month-discriminating cam and to change the month-indication, respectively. If the month-indication newly exposed is one showing a 31-day month, no instructions are transmitted from the control means 4 to the second driving means 2, while, if the month-indication showing the month with thirty days or less is exposed, the control means 4 transmits the signal to the second driving means 2, so that the pawl of the second driving means 2 moves to the position laid in the traveling route of the monthly pin. In this state, however, the monthly pin is positioned out of the acting region of the pawl of the second driving means 2 and accordingly the pawl will not engage with the date-indicating member until the end of this month.

At the end of each 30-day month, the pawl of the first drivng means 1 feeds the date-indicating member to change the indicated 30th day to the 31st day as described above (page 3, lines 26–29, during which the monthly pin engages with the pawl of the second waiting driving means 2. Since the pawl of the second driving means 2, as has been stated, moves with a delay of about three hours with respect to the movement of the pawl of the first driving means, the date indicating means is again fed a further single step by the energization of the pawl of the second driving means 2 after about three hours of the movement by the action of the first driving means, thereby to changing the date indication from. The 31st day to the 1st day. At this moment the monthly pin also affects to the control means 4 so as to change the state of the month-discriminating mechanism and month-indicating means 5 in situ. The month-correcting means is provided for facilitating the month-adjustment in the production of the timepiece.

FIGS. 2 to 5 illustrate a construction of the timepiece embodying this invention in the state that the indication "MON-14-OCT" appears in the window 72 (FIG. 2) provided in the dial (not shown). The energizing means for the calendar mechanism is disposed below a day dial 71 and comprises a hour wheel 73, an intermediate wheel 74 driven by the wheel 73 and a wheel pinion 75 which is coaxially supported with the wheel 74 for driving a first date wheel 11 (included in the first driving means 1 of FIG. 1) and a second date wheel 21 (included in the second driving means 2 of FIG. 1). The first driving means 1 further includes a date dial driving pawl (not shown) supported on the first date wheel 11 and a day dial driving pawl (not shown) for driving an intermediate wheel for a daily star wheel (not shown) and acts to feed a date dial 31 and the intermidiate wheel for the daily star wheel for one step at 12 o'clock midnight every day. Also the intermediate wheel for the daily star wheel drives the daily star to feed a day dial fitted thereto for one step. Namely, the basic function of the first driving, which include a first date wheel 11 means is same as those used in the conventional timepiece with a calendar mechanism.

Referring now to the automatic date correcting mechanism of FIGS. 3 to 5, the second means 2 comprises a shaft 22 rotatably supported on a base plate 76, the second driving date wheel 21 with a pin 23, a driving cam 25 with a second driving pawl 24 and a ring or sheet 26 for restricting the axial movement of the cam 25. The control means 4 comprises a monthly pinion wheel 41 rotatably supported on a shaft 77 planted on the base plate 76, a gear secured to the pinion wheel 41, an intermediate wheel 43 rotatably supported on a shaft 78 planted on the base plate 76, a collar 44 rotatably supported on a shaft 79, a month-discriminating wheel 45 and cam 46 fitted to the collar 44 and a month-discriminating lever 47 rotatably supported on a shaft 80 planted on the base plate 76. Also, the month-indicating means comprises a month dial 51 and a wheel 52 fitted thereto. The month-correcting means 6 is omitted from these figures for the purpose of simplification.

The outer periphery of the cam 46 has a plurality of surfaces **46*b* which are disposed outwardly apart from a plurality of surfaces 46*a* for discriminating the months with 30 or less days. Namely, the outer periphery is divided into twelve regions corresponding to the twelve months, respectively, and the regions corresponding to 30-day months have the surfaces 46*b*. In this embodiment the region corresponding to February has the surfaces 46*a***, because the date correction at the end of February is to be made by hand, the reason of which will be described hereinbelow.

The month discriminating lever 47 has one end which is pressed against one of the surfaces 46a and 46b and the other end which is in contact with the periphery of the cam 25, to transmit the change in the position of one end of the lever 47 to the cam 25. A wire spring 81 is provided for biasing the lever 47 in the clockwise direction about the axis 80. The cam 25 has an elliptical bore 25a through which the shaft 22 penetrates, in order to allow the movement of the cam 25 in the direction parpendicular to the axis thereof, so that the cam 25 will travel in accordance with the radical position of the month-discriminating cam 46. The cam 25 is biased in the counter clockwise direction by means of a wire spring (not shown) so as to be pressed against the second driving pawl 24 at the outer periphery thereof.

The state shown in FIG. 3 by the solid lines corresponds to that at the end of a 31-day month, namely, in the state that the date indication has been changed from the 30th day to the 31st day by the action of the first driving means. At this time the second driving pawl 24 also rotates with the second date wheel 21, but can not engage with the monthly pin 32 because the pawl travels along the route shown by an arrow B. In other words, the second driving pawl 24 can not drive the date dial 31 because the end of the lever 47 is in contact with one of the surfaces **46*a***.

In the period from the last day of a 31-day month to the first day of the next 30-day month, the date dial 31 is fed for one step at the midnight on 31st day to change in indication to the 1st day. At this time the monthly pin 32 moves to the position indicated at **32*a* and feeds the wheel 42 for one step, and the wheel 42 feeds the month dial 51 via the wheel 52 to change the month indication. Also, the pinion wheel 41 transmits its rotation to the cam 46 through the wheels 43 and 45 to thereby for turn the cam 46 for one step. In this stage, the cam 46 is in the position wherein one of the surface 46*b* contacts with the end of the lever 47, so that the rotation of the lever 47 and the movement of the cam 25 will occur, displacing the second pawl 24 so as to move along the surface indicated by an arrow C. Although the pawl 24 rotates for one full turn every day along the route C which intersects the route of the monthly pin 32, the feeding of the date dial 31 is not performed, because the monthly pin 32 has already been displaced to the position 32*a* and pawl 32 can not meet with the monthly pin 32**.

On the last day in a 30-day month, the first driving means feeds the date dial 31 to expose the date indication showing the 31st day and the monthly pin 32 is in the position indicated at 32 in FIG. 3. At this state the second pawl 24 which travels with a predetermined delay relative to the first pawl feeds the monthly pin 32 to the position at **32*a* and, as a result, the date dial 31 is fed a further single step to indicate the 1st day and the month dial 51** is also fed step to change the month indication.

SUMMARY OF OPERATION

In essence, the power transmission wheel 75 drives a gear 11 (FIG. 2) which indexes the month wheel 31 by using a star wheel (not shown) in a conventional fashion. The power transmission wheel 75 also drives the second driving means which is the wheel 21. The wheel 21 has a cam surface 24 thereon which can be displaced to the right as is shown in FIG. 3. When the cam 24 is displaced to the right, it moves from the track "B" where it cannot engage the pin 32 to the track "C" where it can engage the pin 32. The cam 24 is displaced to the right by rotation of the lever 47. The lever 47 is rotated against the bias spring 81 upon engagment between a cam surface **46*b* and the end of the lever. The cam surface 46*b* only comes into contact with the lever 47 during months which have 30 days instead of 31 days and in February, which has** 28 days instead of 31 days.

The date wheel 31 which carries the day of the month makes one complete revolution every 31 days. The date wheel 31 carries a single month pin 32 which once a month engages a star wheel 42 and rotates the star wheel 42 in counterclock-wise direction. The star wheel 42 then rotates the month wheel 51 to index the month wheel one step thereby advancing the month wheel one month.

Each time the star wheel 42 is rotated by the projection 32, which serves as an actuating means for the star wheel, a pinion 41 rotates a gear 43 that meshes with a gear 45 which is coaxially fixed to the cam wheel 46. The cam wheel 46 controls the position of the lever 47 by positioning the surfaces or cams **46*b*. Since the cams 46*b* are spaced at intervals to correspond to 30 day months, the lever 47 will be activated only at the end of 30 day months. When the lever 47 is activated, the cam 24, which is driven by the wheel 21, will engage the month pin 32***b* and advance the date wheel one day so that the 31st day is effectively skipped. The wheel 21 rotates the cam 24 about three hours out of phase with the first driving means, which is the wheel 11.

It will be understood that this invention is not limited to the foregoing description and the following changes and alternations can be made.

1. By increasing the number of revolutions of the second date wheel 21 which is rotated for one revolution a day, as well as by introducing some changes in the resource into the control means 4, it is possible to reduce the time required for the correction of the indication.

2. The monthly pin 32 on the date dial 31 can be replaced with a projection formed integrally with the dial in its coining process.

3. The degree of freedom in the arrangement of the control means will be increased by providing two monthly pins for feeding the date dial and the wheel.

Figure 2:
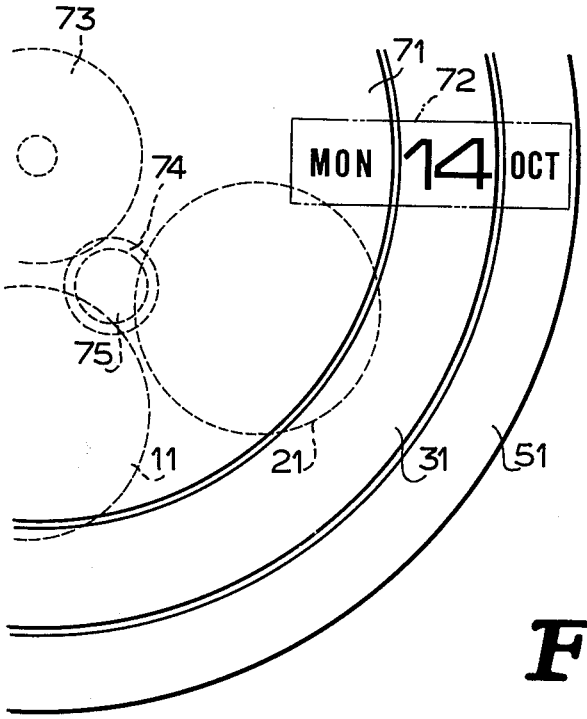
FIG. 2 illustrates in plan an arrangement of the essential parts of the timepiece of this invention.

4. In case of utilizing the month indication as shown in FIG. 2, the optimum rotational angle of the month dial 51 for each step is obtained by forming the month indications corresponding to five years.

5. The month dial 51 which is disposed coaxially with the date dial may be replaced with those having a similar diameter than the date and day dials and supported by a separate shaft from that for date and day dials.

6. Although use is made of the construction wherein the correction at the end of February is manually performed, it is possible to obtain a timepiece with the full automatic date correction mechanism by adding some parts to those described above.

From the foregoing description, it will be apparent that many advantages can be obtained by utilizing this invention, typical advantages being as follows:

a. The correcting mechanism according to this invention is especially suitable for wrist watches owing its simple construction.

b. Two types of timepieces, with and without the automatic date correction mechanism, can be obtained using common movements, because the correction system of this invention may be formed by adding only a second driving means and a small number of additional parts.

c. In the case of timepieces with error amounting about three seconds a month, it is deemed that the mechanism which is capable of automatically correcting the date at the end of February will not be necessary, the reason for which resides in that the timepiece with such accuracy will require operation for adjustment only once a year. In other words, the timepiece according to this invention can be made so that it need not be touched over a period of one year.

d. With the highest class timepieces having error amounting about ten seconds a year, the application of the full automatic correction mechanism will have a justification for existence, even though the complication involved in its construction is to be included.

e. With the high class timepiece having error amounting to about three seconds a month, the month indication may be omitted in order to simplify the design of display surface.

f. If the month correcting means operable from outside of the case is provided, the adjusting operation on setting up or repairing can easily be done. The month correcting means may be so constructed as to be operated by any member such as an enclosing mechanism for an electric battery, a stem, a push button or the like.

According to this invention, as has been stated hereinbefore, there is provided a timepiece with a calendar mechanism which is capable of automatically correcting the date indication and occupies a small space, thereby enhancing its economical and commercial value.

What is claimed is:

1. In a timepiece including a date indicating member which is indexed one step every twenty-four hours to indicate the day of the month, wherein the date indicating member completes one cycle every 31 steps, and wherein a first driving means advances the date indicating member as a power transmission means drives the first driving means, the improvement comprising:

second driving means driven by the power transmission means;

indexing means moved by said second driving means for indexing the date indicating member independently of the first driving means to advance the date indicating means at least one step in addition to the advance caused by the first driving means;

activating means for activating the indexing means;

control means for operating the activating means when the control means is moved from a first condition, representing a month with 31 days, to a second position, representing a month with less than 31 days; and means for indexing the control means once every thirty-one steps of the date indicating member to move the control means from the first condition to the second condition, if the subsequent cycle of the date indicating member represents a month having less than 31 days.

2. The timepiece of claim 1 further including: month indicating means which advances one step each month, and means for indexing the month indicatng means one step every 31 steps of the date indicating.

3. The timepiece of claim 1, wherein the second driving means includes a gear wheel which is rotated once every twenty-four hours and, wherein the second indexing means is mounted on the gear wheel for movement relative to the wheel upon activation by the activating means.

4. The timepiece of claim 1, wherein the activating means is a lever which engages the second indexing means to move the second indexing means upon being pivoted by the control means, wherein the control means is a wheel with a plurality of cam surfaces thereon, and wherein the cam surfaces are spaced on the wheel in a sequence which simulates the spacing of months with 30 days and 31 days, and wherein the cam surfaces are indexed into engagement with the lever as the wheel is indexed.

5. The timepiece of claim 4, wherein the date indicating member is a wheel which rotates one revolution every thirtyone days, and wherein the wheel includes an actuating member thereonwhich cycles once every thirty-one days as the wheel rotates;

the timepiece further including:

a month wheel which indexes one step upon one revolution of the date indicating member to change the month indicated by the timepiece;

transmission means driven by the actuating member for indexing the month wheel; and means driven by the transmission means for moving said means for indexing the control means.

6. The timepiece of claim 5 wherein the transmission means includes a star wheel which is engaged by the actuating member and meshes with teeth on the month wheel to drive the month wheel, and gear means wherein the transmission means includes a pinion, coaxially fixed to the star wheel, which meshes with the means for rotating the control means to index one step upon rotation of the star wheel.

* * * * *

UNITED STATES PATENT OFFICE

CERTIFICATE OF CORRECTION

Patent No. 4,026,100 Dated May 31, 1977

Inventor(s) Kazunari Kume et al.

It is certified that error appears in the above-identified patent and that said Letters Patent are hereby corrected as shown below:

Claim 2, line 4, delete "indicatng", insert -- indicating --

Claim 2, line 5, before "every" insert -- for --

Claim 2, line 5, after "indicating" insert -- means --

Claim 5, line 3, delete "thirtyone", insert -- thirty-one --

Claim 5, line 4, delete "thereonwhich", insert -- thereon which --

Signed and Sealed this thirtieth Day of August 1977

[SEAL]

Attest:

RUTH C. MASON
Attesting Officer

C. MARSHALL DANN
Commissioner of Patents and Trademarks